US010406541B2

(12) United States Patent
Xu et al.

(10) Patent No.: US 10,406,541 B2
(45) Date of Patent: Sep. 10, 2019

(54) OUTLET DEVICE AND SHOWER HEAD WITH FAN-SHAPED PULSATING PARTICLE WATER

(71) Applicant: XIAMEN SOLEX HIGH-TECH INDUSTRIES CO., LTD., Xiamen, Fujian (CN)

(72) Inventors: Wencong Xu, Fujian (CN); Minghao Chen, Fujian (CN); Mingfu Zhang, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 0 days.

(21) Appl. No.: 15/395,241

(22) Filed: Dec. 30, 2016

(65) Prior Publication Data

US 2017/0274395 A1 Sep. 28, 2017

(30) Foreign Application Priority Data

Mar. 28, 2016 (CN) ..... 2016 1 0183475

(51) Int. Cl.

| | |
|---|---|
| ***B05B 3/04*** | (2006.01) |
| *B05B 1/18* | (2006.01) |
| *B05B 1/16* | (2006.01) |

(52) U.S. Cl.

CPC ..... *B05B 3/04* (2013.01); *B05B 1/16* (2013.01); *B05B 1/18* (2013.01)

(58) Field of Classification Search

CPC ..... B05B 3/0422; B05B 1/185; B05B 1/12; B05B 1/16; B05B 1/06; B05B 7/0892; B05B 1/18; E03C 1/0405

USPC .... 239/443, 446–447, 569, 581.1, 282, 565, 239/72; 4/615, 567, 559, 661

See application file for complete search history.

(56) References Cited

U.S. PATENT DOCUMENTS 1,958,038 A * 5/1934 Fraser ..... B05B 1/1636 239/447

4,785,976 A * 11/1988 Bennie ..... A01C 15/16 222/370

(Continued)

FOREIGN PATENT DOCUMENTS

WO WO-2009115325 A1 * 9/2009 ..... B05B 1/14

*Primary Examiner* — Alexander M Valvis

*Assistant Examiner* — Qingzhang Zhou

(74) *Attorney, Agent, or Firm* — Rabin & Berdo, P.C.

(57) ABSTRACT

An outlet device providing fan-shaped pulsating water particles includes a water inlet portion that has at least two inlet holes that are uniformly rotatably symmetrically arranged; and an outlet portion having a single outlet hole such that a vertical projection of the single outlet hole onto a horizontal plane of the water inlet portion partially coincides with one inlet hole of the at least two inlet holes and forms a flow down area and water vertically flows from an overlapping portion of the one inlet hole to a coinciding overlapped portion of the single outlet hole without changing flow direction as flow down water while water tangentially flowing from the one inlet hole toward a non-coinciding portion of the single outlet hole rotates as rotating water and impacts the flow down water to form water particles. A shower head including the outlet device is additionally provided.

4 Claims, 8 Drawing Sheets

(56) References Cited

U.S. PATENT DOCUMENTS

| | | | | |
|---|---|---|---|---|
| 5,090,624 | A * | 2/1992 | Rogers | B05B 1/1645 239/381 |
| 6,796,516 | B2 * | 9/2004 | Maier | F02M 51/0671 239/467 |
| 2013/0221132 | A1 * | 8/2013 | Egli | B05B 1/26 239/490 |
| 2016/0059243 | A1 * | 3/2016 | Parisi-Amon | B05B 1/169 239/444 |

* cited by examiner

OUTLET DEVICE AND SHOWER HEAD WITH FAN-SHAPED PULSATING PARTICLE WATER

FIELD OF THE INVENTION

The present invention relates to an outlet device, particularly to a shower device.

BACKGROUND OF THE INVENTION

There are a great variety of shower heads and different outlet functions. Shower head is developed from single shower function to multi-functional shower head with massage function. A shower head with massage function is realized by water particles impacting the human body to achieve massage effect. But traditional shower head is complicated in structure to realize particle water, the coverage of water particles is not large, the shower effect is not as desired.

SUMMARY OF THE INVENTION

The present invention is provided with an outlet device with fan-shaped particle water effect.

The present invention is further provided with a shower head with fan-shaped particle water effect.

The technical solution of the present invention is that: An outlet device with fan-shaped pulsating particle water, wherein comprising an inlet portion and an outlet portion; the inlet portion comprises at least two inlet holes evenly rotatably symmetrically arranged; the outlet portion comprises an outlet hole; the projection of the outlet hole on the plane of the inlet portion partially coincides with the inlet hole to form a flow down area; water flows to the outlet holes from the flow down area, the flowing direction doesn't change; water flowing to the outlet holes from the rest area of the inlet holes rotates.

In another preferred embodiment, the inlet hole comprises a curve section, two straight sections respectively be tangent to the two ends of the curve section and an arc section connected to the free ends of the two straight section, the curve section is disposed at the end of the inlet hole near to the rotating center point; the projection of the edge of the outlet hole on the inlet portion intersects with the two ends of the curve section, commonly surrounding the flow In another preferred embodiment, the inlet portion is annular, a rib along the diameter direction of the inlet portion is disposed to divide the annular inlet portion into the two inlet holes; the projection of the edge of the outlet hole on the inlet portion intersects with the edge of the rib, commonly surrounding the flow down area.

In another preferred embodiment, the section of the rib is rectangle, tri-forked or cross-shaped.

Another technical solution of the present invention is that: A shower head with fan-shaped pulsating particle water, wherein comprising a main body, an outlet body; the main body is disposed with a chamber, the bottom portion of which is disposed with a plurality of outlet holes; the outlet body is disposed in the chamber, the bottom surface of the outlet body is disposed with inlet portions corresponding to the outlet holes one by one; the inlet portion comprises at least two inlet holes evenly rotatably symmetrically arranged; the projection of the outlet hole on the plane of the inlet portion partially coincides with the inlet hole to form a flow down area; water flows to the outlet holes from the flow down area, the flowing direction doesn't change; water flowing to the outlet holes from the rest area of the inlet holes rotates.

In another preferred embodiment, the inlet hole comprises a curve section, two straight sections respectively be tangent to the two ends of the curve section and an arc section connected to the free ends of the two straight section, the curve section is disposed at the end of the inlet hole near to the rotating center point; the projection of the edge of the outlet hole on the inlet portion intersects with the two ends of the curve section, commonly surrounding the flow down area.

In another preferred embodiment, the inlet portion is annular, a rib along the diameter direction of the inlet portion is disposed to divide the annular inlet portion into the two inlet holes; the projection of the edge of the outlet hole on the inlet portion intersects with the edge of the rib, commonly surrounding the flow down area.

In another preferred embodiment, the section of the rib is rectangle, tri-forked or cross-shaped.

In another preferred embodiment, the inlet portion comprises an inner inlet portion ring and an outer inlet portion ring circle distributed.

In another preferred embodiment, it further comprises a reducing mechanism disposed above the outlet body; the reducing mechanism comprises a driving portion, an inner block ring and an outer block ring; the driving portion drives the inner block ring and the outer block ring to rotate about self axis, making the inner block ring and the outer block ring respectively partially block the inner inlet portion ring and the outer inlet portion ring.

In another preferred embodiment, the driving portion comprises an incline water body, an impeller and an inner gear, the incline water body is disposed with a plurality of incline water cavities, water flowing through the incline water cavities changes the direction and impacts the blades of the impeller to drive the impeller to rotate; the inner gear is coaxially linked to the impeller.

In another preferred embodiment, the side of the outlet body away from the main body extends out axially with a first rotating shaft, the impeller and the inner gear rotates respectively about the first rotating shaft.

In another preferred embodiment, the inner block ring comprises a planetary gear with the same number as the inner inlet portion ring; the planetary gear is engaged to the inner gear, the planetary gear is disposed with a through groove; when the planetary gear rotates to the position that the through groove staggers with the inner inlet portion ring, the inner inlet portion ring is blocked.

In another preferred embodiment, the side of the outlet body away from the main body extends out axially with a second rotating shaft with the same number as the planetary gear, the planetary gear rotates about the first rotating shaft.

In another preferred embodiment, the outer block ring is an outer gear, which is sleeved on the planetary gear and is engaged to the planetary gear; a portion of the external periphery of the outer gear extends out in the radial direction with a platform; when the outer gear rotates to the position that the platform corresponds to the outer inlet portion ring, the outer inlet portion ring is blocked.

Compared to the traditional technology, the technical solution of the present invention has following advantages:

1. The present invention is provided with an outlet device with fan-shaped pulsating particle water that as the inlet hole comprises a curve section and two straight sections respectively be tangent to the two ends of the curve section, and the curve section and the projection of the edge of the outlet hole surround a flow down area, water is divided into two portions during flowing from the inlet hole to the outlet hole. One portion flows directly vertically from the flow down area to the outlet hole; the other portion enters to the outlet hole in the tangent direction of the curve section to form rotating water. The rotating water impacts with the flow down water at the position corresponding to the flow down area and flows out of the outlet hole, as the water impacts, the outlet water forms particles, the impacted water has an intersecting angle with the vertical direction, forming fan-shaped particle water effect. As there are two inlet holes rotatably symmetrically arranged, two sides of the fan-shaped particle water have equal flare angle.

2. The present invention is provided with an outlet device with fan-shaped pulsating particle water that there are three inlet holes rotatably symmetrically arranged, water outlets with tri-forked effect, the intersecting angle of the tri-fork is 120°.

3. The present invention is provided with an outlet device with fan-shaped pulsating particle water that there are four inlet holes rotatably symmetrically arranged, water outlets with cross effect, the intersecting angle of the cross is 90°.

4. The present invention is provided with a shower head with fan-shaped pulsating particle water that, besides above mentioned outlet effect, the inlet portion comprises an inner inlet portion ring and an outer inlet portion ring circle distributed, making the outlet water with inner water ring and outer water ring and thus improving the layering of the outlet; further comprises a reducing mechanism; the reducing mechanism making the inner block ring and the outer block ring respectively partially block the inner inlet portion ring and the outer inlet portion ring, thus making the outlet with rhythm sensation and forming intermittent outlet with a certain cyclic frequency.

DETAILED DESCRIPTION OF THE EMBODIMENTS

The present invention will be further described with the drawings and the embodiments.

Embodiment 1

Figure 1:
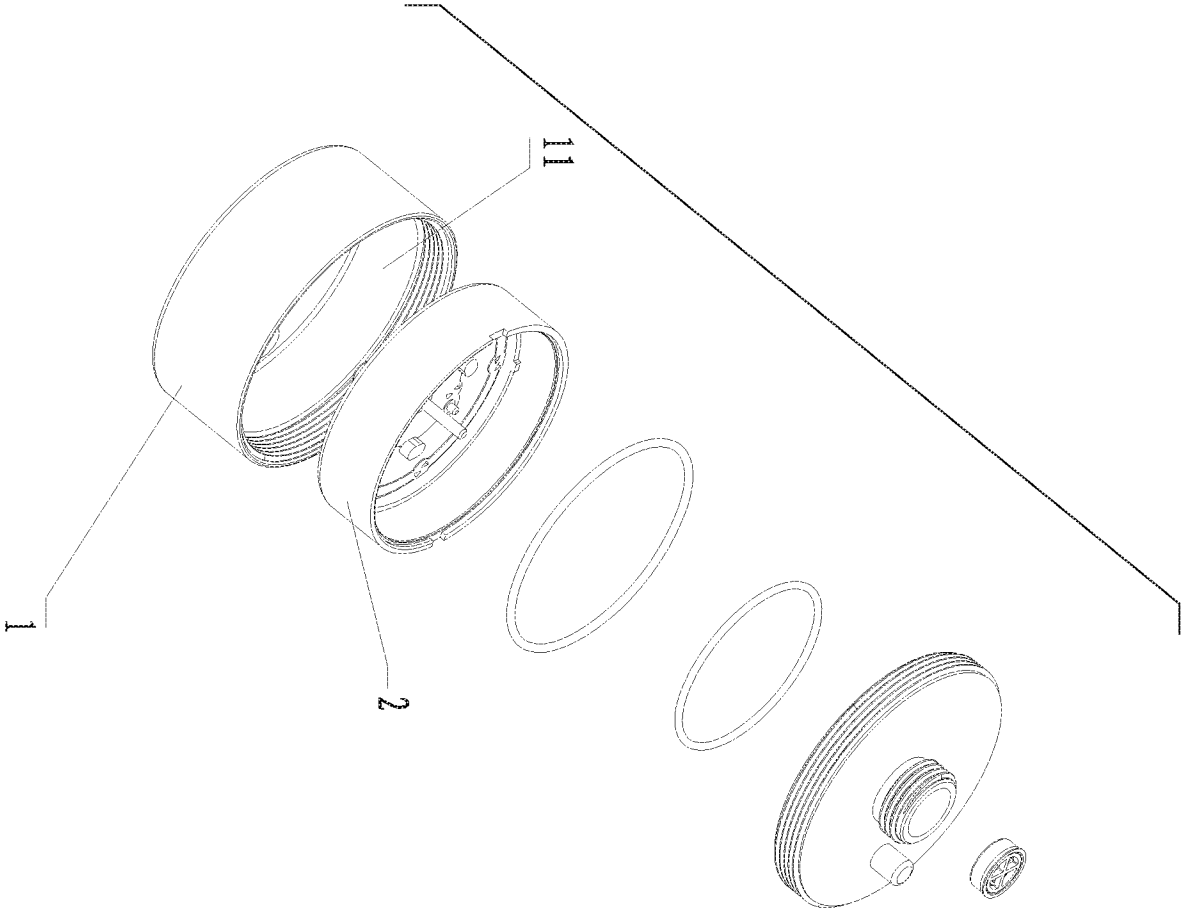
FIG. 1 illustrates an exploded and schematic diagram of a shower head of Embodiment 1 of the present invention.
Figure 2:
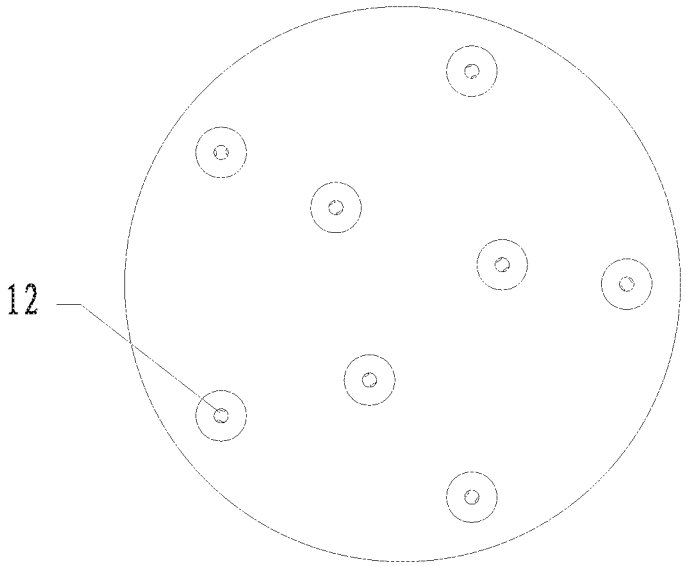
FIG. 2 illustrates a schematic diagram of an outlet hole of Embodiment 1 of the present invention.
Figure 3:
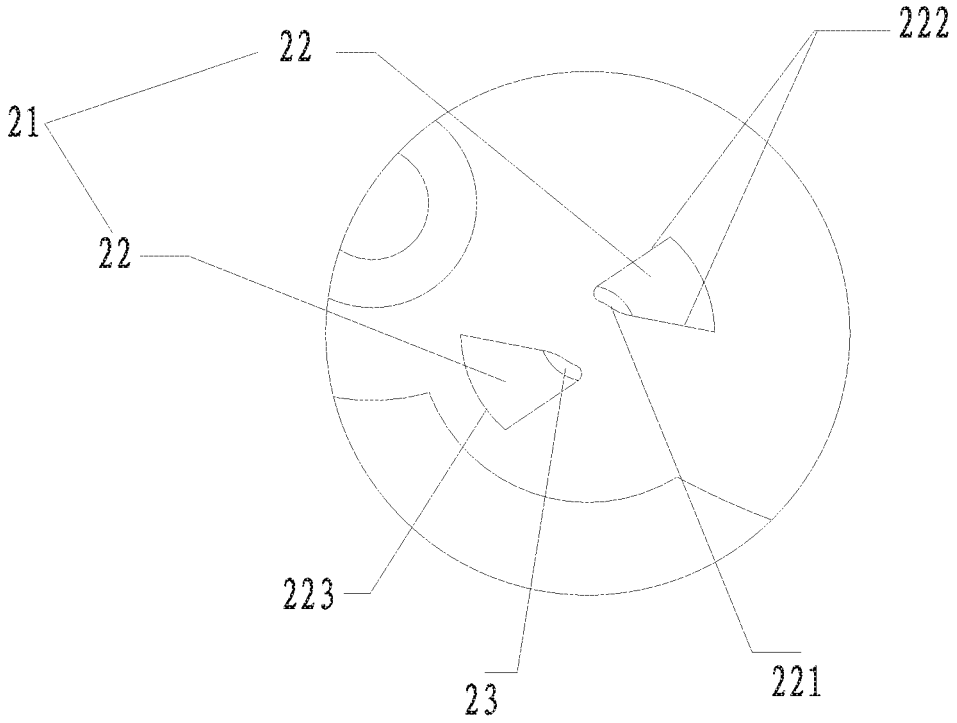
FIG. 3 illustrates a schematic diagram of an inlet hole of Embodiment 1 of the present invention.

Referring to FIGS. 1-3, a shower head with fan-shaped pulsating particle water comprises a main body 1 and an outlet body 2;

The main body 1 is disposed with a chamber 11, the bottom portion of which is disposed with a plurality of outlet holes 12; the outlet body 2 is disposed in the chamber 11, the bottom surface of the outlet body is disposed with inlet portions 21 corresponding to the outlet holes 12 one by one;

the inlet portion 21 comprises at least two inlet holes 22 evenly rotatably symmetrically arranged; the inlet hole 22 comprises a curve section 221, two straight sections 222 respectively be tangent to the two ends of the curve section 221 and an arc section 223 connected to the free ends of the two straight section 222, the curve section 221 is disposed at the end of the inlet hole near to the rotating center point;

The projection of the edge of the outlet hole 12 on the inlet portion 21 intersects with the two ends of the curve section 221, commonly surrounding the flow down area 23. Water is divided into two portions during flowing from the inlet hole 22 to the outlet hole 12. One portion flows directly vertically from the flow down area to the outlet hole 12; the other portion enters to the outlet hole 12 in the tangent direction of the curve section 221 to form rotating water. The rotating water impacts with the flow down water at the position corresponding to the flow down area and flows out of the outlet hole 12, as the water impacts, the outlet water forms particles, the impacted water has an intersecting angle with the vertical direction, forming fan-shaped particle water effect. As there are two inlet holes 22 rotatably symmetrically arranged, two sides of the fan-shaped particle water have equal flare angle.

Embodiment 2

Figure 4:
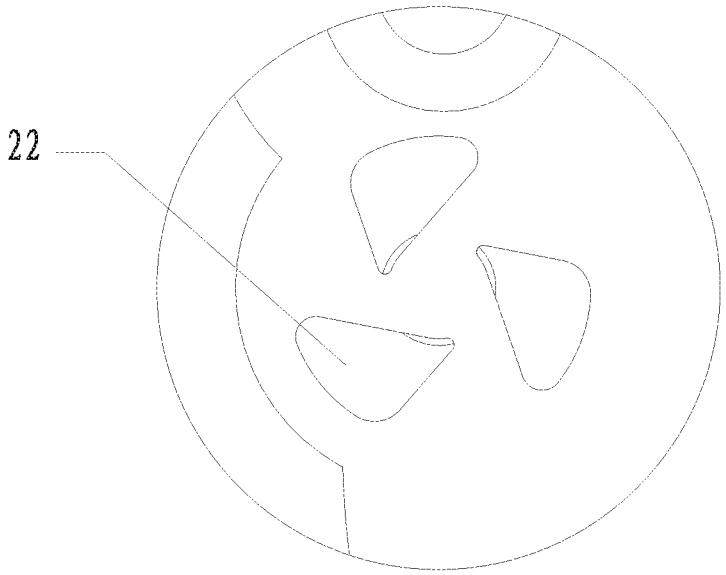
FIG. 4 illustrates a schematic diagram of an inlet hole of Embodiment 2 of the present invention.

Referring to FIG. 4, this embodiment differs from Embodiment 1 in that: there are three inlet holes 22 rotatably symmetrically arranged, water outlets with tri-forked effect, the intersecting angle of the tri-fork is 120°. The rest portion of this embodiment is similar to Embodiment 1 that it would not be further described.

Embodiment 3

Figure 5:
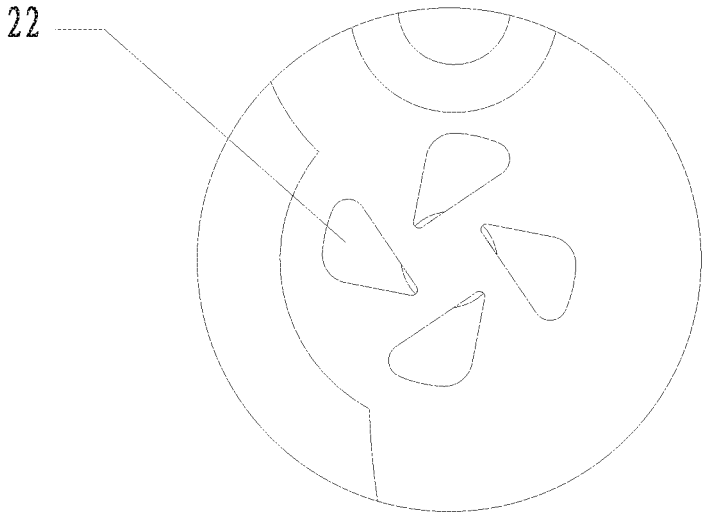
FIG. 5 illustrates a schematic diagram of an inlet hole of Embodiment 3 of the present invention.

Referring to FIG. 5, this embodiment differs from Embodiment 1 in that: there are four inlet holes 22 rotatably symmetrically arranged, water outlets with cross effect, the intersecting angle of the cross is 90°. The rest portion of this embodiment is similar to Embodiment 1 that it would not be further described.

Embodiment 4

Figure 6:
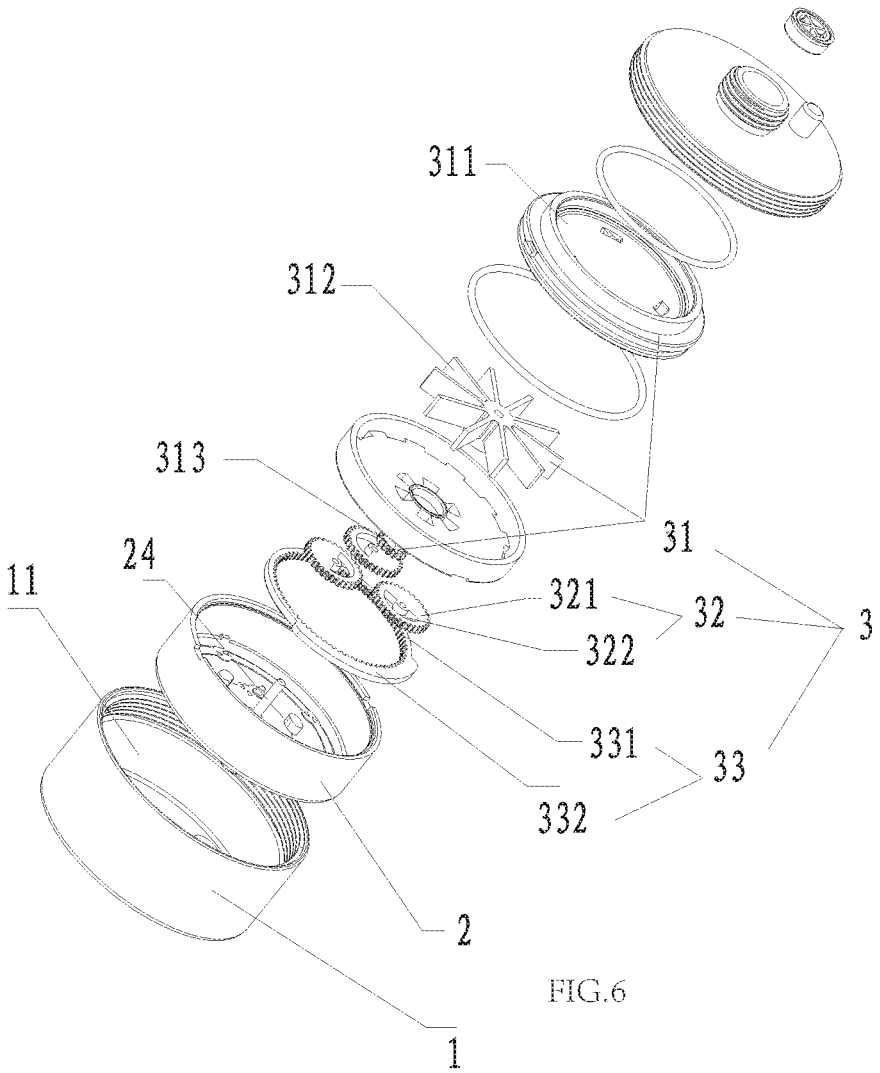
FIG. 6 illustrates an exploded and schematic diagram of a shower head of Embodiment 4 of the present invention.
Figure 7:
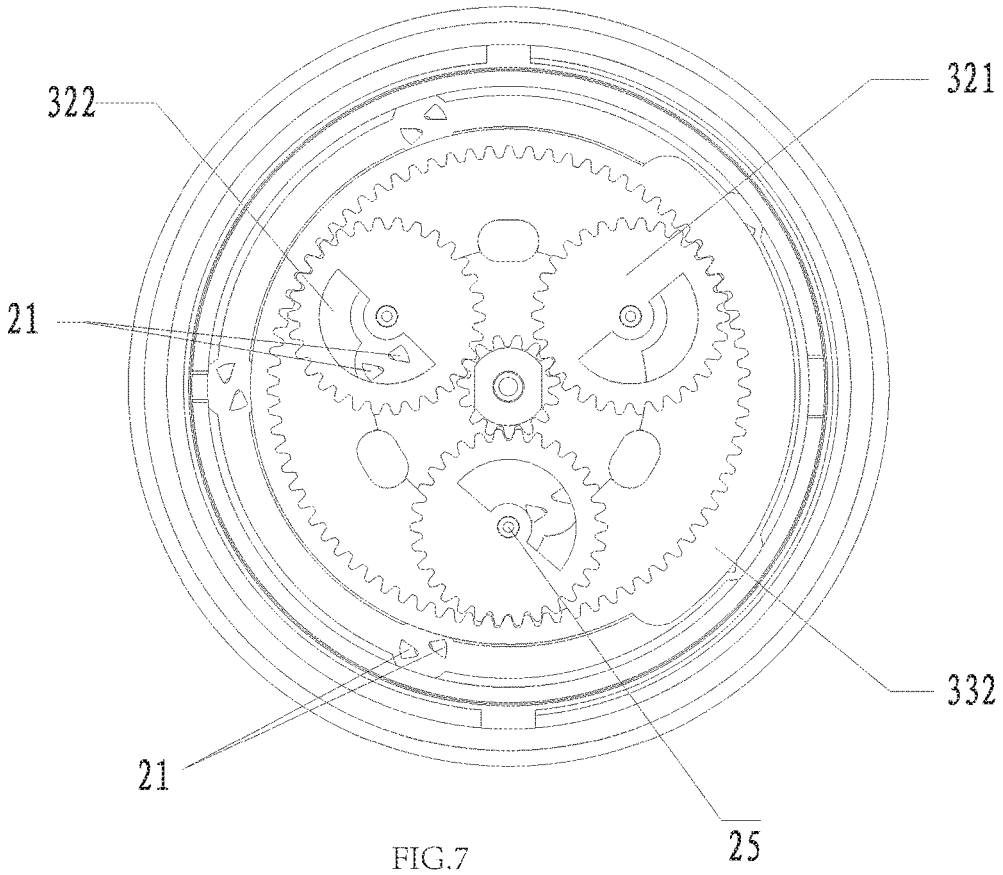
FIG. 7 illustrates a schematic diagram of a reducing mechanism of Embodiment 4 of the present invention.
Figure 8:
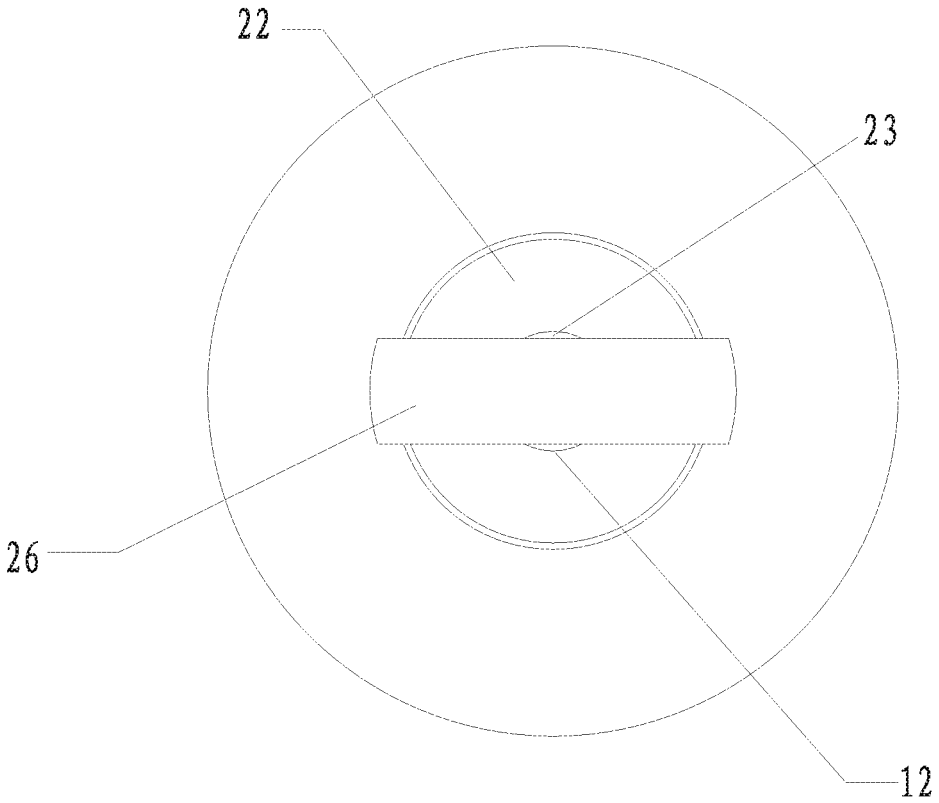
FIG. 8 illustrates a schematic diagram of an inlet hole of Embodiment 5 of the present invention.

Referring to FIGS. 6-7, this embodiment differs from Embodiment 1 in that: the inlet portion 21 comprises an inner inlet portion ring and an outer inlet portion ring circle distributed, making the outlet water with inner water ring and outer water ring and thus improving the layering of the outlet.

This embodiment further comprises a reducing mechanism 3 disposed above the outlet body 2; the reducing mechanism 3 comprises a driving portion 31, an inner block ring 32 and an outer block ring 33; the driving portion 31 drives the inner block ring 32 and the outer block ring 33 to rotate about self axis, making the inner block ring 32 and the outer block ring 33 respectively partially block the inner inlet portion ring and the outer inlet portion ring, thus making the outlet with rhythm sensation and forming intermittent outlet with a certain cyclic frequency.

In this embodiment, the driving portion 31 comprises an incline water body 311, an impeller 312 and an inner gear 313, the incline water body 311 is disposed with a plurality of incline water cavities. The side of the outlet body 2 away from the main body 1 extends out axially with a first rotating shaft 24, the impeller 312 and the inner gear 313 are rotatably connected to the first rotating shaft 24, thus rotating coaxially respectively about the first rotating shaft 24. Water flowing through the incline water cavities changes the direction and impacts the blades of the impeller 312 to drive the impeller 312 to rotate; the inner gear 133 rotates synchronously with the rotating of the impeller 312.

The inner block ring 32 comprises a planetary gear 321 with the same number as the inner inlet portion ring; the side of the outlet body 2 away from the main body 1 extends out axially with a second rotating shaft 25 with the same number as the planetary gear 321, the planetary gear 321 rotates about the first rotating shaft 25. The planetary gear 321 is engaged to the inner gear 313, the planetary gear 321 is disposed with a through groove 322; when the planetary gear 321 rotates to the position that the through groove 322 staggers with the inner inlet portion ring, the inner inlet portion ring is blocked.

The outer block ring 33 is an outer gear 331, which is sleeved on the planetary gear 321 and is engaged to the planetary gear; a portion of the external periphery of the outer gear 331 extends out in the radial direction with a platform 332; when the outer gear 331 rotates to the position that the platform 332 corresponds to the outer inlet portion ring, the outer inlet portion ring is blocked.

Therefore, with above mentioned structure, the reducing mechanism 3 makes the inner inlet portion ring and the outer inlet portion ring partially be blocked, thus making the outlet with rhythm sensation and forming intermittent outlet with a certain cyclic frequency.

Embodiment 5 this embodiment differs from Embodiment 1 in that: in this embodiment, the inlet portion 21 is annular, a rib 26 with rectangle section along the diameter direction of the inlet portion 21 is disposed to divide the annular inlet portion into the two inlet holes 22; the inlet holes 22 are rotatably symmetrically about the axis of the inlet portion 21; the projection of the edge of the outlet hole 12 on the inlet portion 21 intersects with the edge of the rib 26, commonly surrounding the flow down area 23.

The outlet water effect and the principle are similar to Embodiment 1 that it would not be further described.

The section of the rib 26 can be tri-forked or cross-shaped to divide the inlet portion into three or four inlet holes 22, the water effect are corresponding respectively to Embodiment 3 and Embodiment 4.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. An outlet device providing fan-shaped pulsating water particles, comprising:

a water inlet portion that comprises at least two inlet holes that are evenly rotatably symmetrically arranged; and an outlet portion having a single outlet hole such that a vertical projection of the single outlet hole onto a horizontal plane of the water inlet portion partially coincides with one inlet hole of the at least two inlet holes and forms a flow down area and water vertically flows from an overlapping portion of the one inlet hole to a coinciding overlapped portion of the single outlet hole without changing flow direction as flow down water while water tangentially flowing from the one inlet hole toward a non-coinciding portion of the single outlet hole rotates as rotating water and impacts the flow down water to form water particles, wherein the water inlet portion is annular to provide an annular inlet portion, wherein the outlet device further comprises a rib disposed along a diameter direction of the annular inlet portion that divides the annular inlet portion into the two inlet holes, and wherein a vertical projection of an edge of the single outlet hole on a horizontal plane of the water inlet portion intersects with an edge of the rib to commonly surround the flow down area.

2. The outlet device according to claim 1, wherein the rib has a cross-section that is a rectangle, that is tri-forked, or that is cross-shaped.

3. A shower head providing a fan-shaped pulsating water spray, comprising:

a main body provided with an accommodating chamber having a bottom portion in which is defined a plurality of outlet holes; and an outlet body disposed in the accommodating chamber and having a bottom surface disposed with a water inlet portion, wherein the water inlet portion comprises at least two inlet holes uniformly rotatably symmetrically arranged such that a vertical projection of each respective outlet hole of the plurality of outlet holes onto a horizontal plane of the water inlet portion partially coincides with a respective one inlet hole of the at least two inlet holes and forms a flow down area and water vertically flows from an overlapping portion of the respective one inlet hole to a coinciding overlapping portion of each respective outlet hole without changing flow direction as flow down water while water tangentially flowing from the respective one inlet hole toward a non-coinciding portion of each respective outlet hole rotates as rotating water and impacts the flow down water to form water particles, wherein the water inlet portion is annular to provide an annular inlet portion, wherein the shower head further comprises a rib disposed along a diameter direction of the annular inlet portion that divides the annular inlet portion into the two inlet holes, and wherein a vertical projection of an edge of each respective outlet hole on a horizontal plane of the annular inlet portion intersects with an edge of the rib to commonly surround the flow down area.

4. The shower head according to claim 3, wherein the rib has a cross-section that is a rectangle, that is tri-forked, or that is cross-shaped.

* * * * *